US012030686B2

(12) United States Patent
Jonker et al.

(10) Patent No.: US 12,030,686 B2
(45) Date of Patent: Jul. 9, 2024

(54) SYSTEM AND METHOD FOR CONTROLLING PROCESSING IN AN AUTOMATED PACKAGING PROCESS AND SYSTEM AND METHOD FOR AUTOMATICALLY PACKAGING SHIPMENT SETS

(71) Applicant: SPARCK TECHNOLOGIES B.V., Drachten (NL)

(72) Inventors: Melle Jonker, Drachten (NL); Eelke Visser, Drachten (NL)

(73) Assignee: SPARCK TECHNOLOGIES B.V., Drachten (NL)

( * ) Notice: Subject to any disclaimer, the term of this patent is extended or adjusted under 35 U.S.C. 154(b) by 74 days.

(21) Appl. No.: 17/745,096

(22) Filed: May 16, 2022

(65) Prior Publication Data

US 2022/0363423 A1 Nov. 17, 2022

(30) Foreign Application Priority Data

May 17, 2021 (DE) ..... 10 2021 112 728.9

(51) Int. Cl.
*B65B 5/02* (2006.01)
*B65B 57/16* (2006.01)
(Continued)

(52) U.S. Cl.
CPC ..... *B65B 57/16* (2013.01); *B65B 5/024* (2013.01); *B65B 59/001* (2019.05); *B65B 59/02* (2013.01);
(Continued)

(58) Field of Classification Search
USPC ..... 53/427
See application file for complete search history.

(56) References Cited

U.S. PATENT DOCUMENTS

2019/0152634 A1* 5/2019 Almogy ..... B65G 1/06
2021/0300612 A1* 9/2021 Pettersson ..... B65B 59/02

FOREIGN PATENT DOCUMENTS

EP 3674235 A1 7/2020
WO 2014117817 A1 8/2014
(Continued)

OTHER PUBLICATIONS

"International Fibreboard Case Code," published by FEFCO and ESBO, 2007, 11th edition.

*Primary Examiner* — Chinyere J Rushing-Tucker
(74) *Attorney, Agent, or Firm* — Cozen O'Connor

(57) ABSTRACT

A method for controlling the processing of varying shipment sets of one or more item(s) in an automated packaging system for packaging said varying shipment sets in custom-sized boxes made from cardboard blanks, said packaging system comprising a plurality of processing stations performing different operations on said shipment sets, said operations including transporting said shipments sets to and through said stations, said method comprising: acquiring information about one or more physical properties of a shipment set or the item(s) forming the shipment set, determining based on said information if the shipment set needs or allows a specific treatment in or on the transport to and through one or more of said processing stations within said packaging system, and configuring said one or more of said processing stations with instructions for said specific treatment of said shipment set.

20 Claims, 9 Drawing Sheets

(51) Int. Cl.

| | |
|---|---|
| ***B65B 59/00*** | (2006.01) |
| ***B65B 59/02*** | (2006.01) |
| ***B65B 61/00*** | (2006.01) |
| ***B65B 65/00*** | (2006.01) |

(52) U.S. Cl.
CPC ..... *B65B 61/005* (2013.01); *B65B 65/003* (2013.01); *B65B 2210/04* (2013.01)

(56) References Cited

FOREIGN PATENT DOCUMENTS

| | | | |
|---|---|---|---|
| WO | 2014118629 | A2 | 8/2014 |
| WO | 2016059218 | A1 | 4/2016 |
| WO | 2019081773 | A1 | 5/2019 |

* cited by examiner

SYSTEM AND METHOD FOR CONTROLLING PROCESSING IN AN AUTOMATED PACKAGING PROCESS AND SYSTEM AND METHOD FOR AUTOMATICALLY PACKAGING SHIPMENT SETS

TECHNICAL FIELD OF THE INVENTION

The invention relates to a system and a method for controlling processing, e.g. accelerations and decelerations of transport (for example conveyor) means and/or a holding time in e.g. a curing station, in an automated packaging system for packaging varying shipment sets, i.e. sets of one or more items to be shipped, in which at least one of the number, the type and the size of the items vary, in boxes, in particular custom-sized boxes made from cardboard blanks. The invention also relates to a system and a method for automatically packaging varying shipment sets in custom-sized cardboard boxes employing the system and the method for controlling the processing.

TECHNICAL BACKGROUND

Mail ordering has become a widely used way of buying goods. More and more companies offer virtual department stores, in which the customers can electronically put goods in a shopping cart that later will be transferred by the respective company into a dispatch order so that in a warehouse a shipment set comprising the items ordered can be assembled based on the respective dispatch order. Typically, a thus assembled shipment set is then transferred to and entered in a system for automatically packaging shipment sets in particular in custom-sized boxes.

For automating the packaging of varying shipment sets, different systems have been proposed. One approach is shown in WO 2016/059218 A1, which discloses a system and a method for automatically packaging varying shipment sets employing two separate packings, namely an inner packing surrounding the items to be packaged in a first direction, and an outer packing surrounding the inner packing in a second direction, said second direction being substantially perpendicular to the first direction such that the inner and the outer packing form a combined package enclosing the package items from all sides.

A different approach is shown in WO 2014/118629 A2 and WO 2014/117817 A1, which teach systems that allow—within the boundaries imposed by the material used—creating a fully custom-sized box, i.e. a cuboid box, of which width, length and height are adapted to the respective content of the box. It has turned out that such systems allow, in particular by using a special box design as disclosed in WO 2019 081773 A1, packaging about 1000 and more varying shipment sets per hour.

The known systems typically create boxes by first obtaining information on the outer dimensions length, width and height of the shipment set to be packaged and calculating based on this information the layout of a custom-sized cardboard blank (sometimes called template or piano) comprising different so called panels, which are delimited from each other by crease lines or indentations and incisions allowing the panels to be folded in order to create the box wanted. A piece of cardboard supplied from a roll of cardboard or a stack of zig-zag cardboard is then cut-off, indented and incised (not necessary in this order) to form the blank.

Depending on the specific way the packaging system works, a box with or without an attached lid may then be formed automatically by gripping and folding the blank. In the "International Fibreboard Case Code" published by FEFCO and ESBO, 2007, $11^{th}$ edition, many different box layouts are disclosed, some of which are easy to handle in automated packaging systems, and the respective boxes may be closed with attached or separate lids.

While the known systems and methods for automating the packaging process work well for a number of applications, and in particular the system disclosed in WO 2014/117817 A1 has proven to allow packaging varying shipment sets fully automatically, it has turned out that there is still a need for optimization of the packaging process.

Conventionally, the item(s) forming a shipment set to be packaged are manually or automatically picked from a storage and brought to an arranging station, where they are manually or automatically arranged, i.e. positioned with respect to a later created box (and with respect to each other, if more than one item is to be packaged in the same box), in a configuration (hereinafter called "arrangement") that is considered suitable or even optimal with respect to different optimization criteria (such as volume of the box to be created).

In arranging the items, different boundary conditions have to be observed, such as for example maximum width of the box to be created, as the boxes are typically created from cardboard having a certain width fed to a system for cutting, creasing and folding the cardboard around the arrangement of one or more items to be packaged.

Arranging the items and observing the boundary conditions is time consuming and obviously takes the longer the more items have to be arranged. Arranging is typically done on a conveyor, typically a conveyor belt, which then transports the arrangement to the packaging station. If it takes longer to prepare an arrangement than it takes to package a previously prepared arrangement, the packaging process slows down as the packaging station has to wait for the next arrangement.

Time lost in arranging the items can typically not be made up by increasing the speed of the conveyor transporting the respective arrangement from the arranging station to the packaging station, as the items may tumble and even fall down from the conveyor, in particular if the items do not have a cuboid or other shape that could provide a stable, not easy to tilt basis, or have such shape but are placed such that their center of mass can easily be brought out of the support area, such as is the case for typical bottles or parts encased in complex shaped blister packages. It is therefore common to ensure that an arrangement of one or more items upon transporting it from the arranging station to the packaging station is not subjected to accelerations or decelerations above a certain threshold maximum value, e.g. $\pm 1$ m/s$^2$. Note that modern packaging systems may comprise many different stations, e.g. 10 to 20, for treating the shipment set, the box and the lid until the shipment set is fully packaged and the corresponding box is properly closed and labelled.

However, setting certain boundaries for accelerations/decelerations and hence affecting the overall processing speed and the time it takes to process a shipment set by a system for automated packaging is often done solely based on the experience of the operators of such system, and no shipment set specific values are set, which delimits the throughput of a corresponding packaging system in two ways: If a shipment set comprises e.g. only one item like a box with shoes, which has a flat bottom leading to a large contact surface with a cardboard blank, from which a box is folded, the processing speed could be increased without increasing the danger that the item could tilt or even slip from the cardboard blank. On the other hand, for certain shipment sets in particular sets comprising multiple items, of which some may be heavier than others, the typical maximum acceleration/deceleration may already be too much to ensure that the shipment set stays in the specific arrangement, in which a calculated box could be folded around it.

The problem is not limited to the part of the packaging process, in which the shipment sets to be packaged are transported onto a cardboard blank, but continues until a fully closed box is folded. At present, systems using so called "tray type" boxes, i.e. boxes without attached lids like the ones shown in WO 2019 081773 A1 or the ones shown under item 0300 in the International Fibre Board Case Code mentioned above, seem to allow the highest throughput of shipment sets packaged per hour. If such box comprises one or more heavy items and is decelerated or accelerated, there is a risk that the contents of the box shift or tilt and press against a wall of the box, which has just been formed by folding and gluing together certain panels of a respective cardboard blank.

Typically, hot melt glue is used in such box forming process, and if the hot melt glue keeping the box together has not yet fully cured there is a risk that the contents of the box push against a wall of the box that then falls open. Depending on the respective system, boxes are sometimes transported by a so called finger transport pushing a respective box forward. A heavy item that is asymmetrically placed may bump against a wall when the box is accelerated or decelerated too fast, causing the box to tilt, which may then make it impossible to correctly place in an automated system a lid on the box.

Another problem is that if the side walls of a box that are glued to e.g. corner panels of the box are not very high and rather long, only a few lines of glue can be applied in an automated system while the return forces from the side panels folded upwards are rather high (as known, folded cardboard panels have a tendency to return towards their unfolded position). In such case, it needs to be ensured that the glue is fully cured to avoid that a side panel falls open, and hence the box has to be kept longer in respective curing station.

Another problem is that some boxes have a partial opening at the sides (which later is covered by a respective lid). Depending on the specific arrangement, a small item may fall out of such opening if the respective box is accelerated or decelerated too much.

Another problem is that sometimes an item in a shipment set is smaller than the minimum size of the box in either length or width direction or both. In that case the minimum size for the length and/or width is used, but there will be free space at one or more side of the shipment set to be packaged allowing the shipment set to slide in the box. A similar effect may occur if a shipment set comprises multiple items that do not form an exactly rectangular arrangement, e.g. a small item on top of a larger item.

The aforementioned problems are not limited to tray boxes. Similar problems may occur whenever varying shipment sets are automatically packaged.

The problem of choosing the "correct" acceleration and deceleration is increased by the fact that automated packaging systems are with respect to the data available to them usually completely separated from a respective warehouse system and can be operated more or less independently of the warehouse system. Thus, an automated packaging system can be regarded as a "service provider" for the warehouse system respectively for a mail ordering retailer, and basically the packaging system does neither know nor understand which and how many items are comprised in a shipment set to be packaged (some special packaging instructions may be provided to the packaging system for example by specially marking certain items like breakable items, fluids, batteries etc. that may need a special packaging). The dispatch order containing the information, which customer ordered which items and to which address the respective shipments shall be sent, is unknown to the packaging system. From the viewpoint of the packaging system, it just gets "something" (namely the shipment set) that has to be packaged and so called processing data which typically includes e.g. a print file for printing a shipping label, information for printing on the box, information for creating a box, information for using a specific cardboard type for the box, adding certain void fill, vouchers, samples, etc.

To increase the throughput of a packaging system, a system and a method for transporting items to a packaging station have been proposed in EP 3 674 235 A1 employing two or more arranging stations, each adapted for arranging one or more items into shipments sets to be packaged, and multiple conveyers for transporting the shipment sets to a packaging station comprising structure for cutting and creasing custom-sized cardboard blanks and structure for folding a respective blank after a shipment set of one more items has been transported onto it. Such use of multiple conveyers allows to work in parallel on the arranging of shipment sets and to hence increase the throughput of a packaging system to a certain extent, while the aforementioned limitation regarding the maximum acceleration or deceleration remains.

To at least partially solve some of the aforementioned problems, WO 2020/051090 proposes adjusting the speed, the acceleration and the deceleration of a conveyor transporting items to be packaged onto a cardboard blank. The dimensions and/or weight of the items and the friction between the items and the conveyor are determined to adjust the speed, the acceleration and the deceleration of the conveyor such that the items do not shift, tip or otherwise fall out of position before being placed on the cardboard blank.

SUMMARY

In view of the aforementioned problems, it is an object of the invention to provide a system and a method for controlling processing in an automated packaging system for packaging varying shipment sets to increase the throughput of the packaging system while avoiding the danger that for example due to high accelerations or decelerations the items forming the shipment sets tumble and fall down or at least leave their designated position in an arrangement of multiple items and then press against the panels of a box that then fall open due to insufficient curing of glue.

The object is achieved by a method according to claim 1 respectively a system according to claim 13. Independent claim 14 relates to a method for automatically packaging varying shipment sets in custom-sized cardboard boxes employing the method of claim 1. Independent claim 15 relates to a packaging system for automatically packaging varying shipment sets in custom-sized cardboard boxes employing the control system of claim 13. Advantageous embodiments are subject of the dependent claims.

The invention allows to automatically optimize the throughput of a packaging system for the automated packaging of shipment sets by ensuring that whenever possible the processing is done at a high processing speed in a station and with high acceleration/deceleration when transporting shipment sets from one station to another leading to a high overall processing speed, while ensuring that whenever necessary the processing speed in a station and/or the accelerations/deceleration are lowered to avoid interruptions of the packing process. In one embodiment, the method and the system may be configured as a self-learning method respectively system that constantly improves by experience gained through handling many different shipment sets.

In a first embodiment, a method for controlling the processing of varying shipment sets of one or more item(s) in an automated packaging system for packaging said varying shipment sets in custom-sized boxes made from cardboard blanks, said packaging system comprising a plurality of processing stations performing different operations on said shipment sets, said operations including transporting said shipments sets to and through said stations, comprises the steps of

- acquiring information about one or more physical properties of a shipment set or of the item(s) forming the shipment set,
- determining based on said information if the shipment set needs or allows a specific treatment in or on the transport to and through one or more of said processing stations within said packaging system, and
- configuring said one or more of said processing stations with instructions for said specific treatment of said shipment set,
- wherein said specific treatment of said shipment set comprises at least one of
  - decreasing or increasing the time spent in a curing station for curing hot melt glue used to form a custom-sized box for said shipment set, and
  - decreasing or increasing the time a custom-sized box holding said shipment is hold fixed, in particular after deceleration, to let the shipment set in the box stabilize in its position.

In this respect, it should be noted that information about the shipment set can be acquired in multiple ways, and the invention advantageously allows using the most appropriate way of acquiring such information. For example, an image of the complete or parts of the shipment set may be taken and/or RFID tags, barcodes, QR codes etc. of one or more items of the shipment set may be scanned. As outlined above, different properties of a shipment set and the item(s) forming such set can affect the processing in the packaging system and accordingly there are multiple ways of detecting them. Thus, the invention advantageously allows optimizing the processing in multiple ways.

In one embodiment, one of said one or more physical properties is the weight of the shipment set or of the item(s) forming the shipment set. As outlined above, the weight, or rather the moment of inertia an item has due to its weight, may lead to certain problems in the packaging process. The information about the weight of the shipment set or of the item(s) forming the shipment may be acquired in different ways, e.g. by using a scale in particular at a so-called entry or arrangement station, where items are arranged for being packaged, by obtaining data from a database, or by monitoring the current of a conveyor or a transport element pushing or pulling when accelerating or transporting said shipment set. Monitoring the current can easily be implemented by existing packaging systems for automated packaging. Typically, a certain target acceleration or target speed is preset for such conveyors or transport elements, and as these work with constant voltage, the current need to achieve said target values varies.

Another one of said one or more physical properties that may affect the processing is the shape of the shipment set or of the item(s) forming the shipment set, and information about the shape can be gained by using a camera, a laser scanner or other suitable detecting equipment. The shape may be an indicator that the shipment set will rest very stable e.g. on a conveyor or the bottom of a box, so that the processing speed, in particular the allowed values for accelerations and decelerations the shipment set undergoes will being processed by the packaging system can even be increased. Likewise, the shape may also indicate that the shipment set will not rest very stable on a conveyor or the bottom of a box and accelerations/decelerations should be limited.

Further ones of said one or more physical properties that may affect the processing are the extension of the shipment set in each spatial direction and the extension of each item in the shipment set in each spatial direction. If a shipment set has certain extensions that require a rather flat box (like a pizza box), the box may be, as outlined above, difficult to make and as for example only rather few glue may be applicable, the box may need longer support in a gluing station to allow the glue to cure, while other boxes may be released from such stations earlier while the glue has not fully cured. Likewise, if a single item in a shipment is very small, it may fall out of a box having a gap between its corner panels when the shipment set is accelerated or decelerated too much, which will be described with respect to FIG. 9*c* later.

Another one of said one or more physical properties is the spatial position of the center of mass of each item in the shipment set, which may increase or decrease the position stability of the item in the shipment set and may accordingly allow higher or require lower accelerations/decelerations. In general, the more free space there is around the items in a shipment set, the more there is a risk that in processing such shipment set items tumble around and the more care has to be taken in processing it. Another one of said one or more physical properties is the spatial position of the center of mass of an aggregate of all of the items in the shipment set.

According to one embodiment, said specific treatment further comprises at least one of

- decreasing or increasing the allowed acceleration when transporting said shipment set,
- decreasing or increasing the allowed deceleration when transporting said shipment set, and
- decreasing or increasing the allowed transportation speed when transporting said shipment set.

The decreasing or increasing mentioned in this disclosure may be done in a stepped or stepless manner, and the invention advantageously allows choosing the most suitable manner for the respective packaging system. In order to do so, the method may use a linear relation, an exponential relation or a look-up table to determine a value for said decrease or increase.

Depending on the specific implementation, said acceleration and/or deceleration may only be decreased or increased in one or more specific transport direction(s). As outlined above, one problem addressed by the invention is the risk that an item falls against a wall and pushes it open or tilts the box making it difficult to correctly position a lid. This problem may however only exist if the respective shipment set is accelerated or decelerated in a certain direction, while it may not exist for accelerations or decelerations in other directions.

In one embodiment, a system for controlling the processing of varying shipment sets of one or more item(s) by an automated packaging system for packaging said varying shipment sets in custom-sized boxes made from cardboard blanks, said packaging system comprising a plurality of processing stations performing different operations on said shipment sets, said operations including transporting said shipments sets to and through said stations, comprises

- means for acquiring information about one or more physical properties of a shipment set or of the item(s) forming the shipment set,
- means for determining based on said information if the shipment set needs or allows a specific treatment at certain processing stations within said packaging system, and
- means for configuring said processing stations with instructions for the specific treatment of said shipment set,
- wherein said specific treatment of said shipment set comprises at least one of
  - decreasing or increasing the time spent in a curing station for curing hot melt glue used to form a custom-sized box for said shipment set, and
  - decreasing or increasing the time a custom-sized box holding said shipment is hold fixed, in particular after deceleration, to let the shipment set in the box stabilize in its position.

Said means for acquiring information about one or more physical properties of a shipment set or of the item(s) forming the shipment set may comprise amongst others a camera, a laser scanner, RFID tag reader, a barcode reader, a QR code reader, a scale, a database, a contact-based coordinate measuring machine with a contact probe, a current meter for monitoring the current of a conveyor or a transport element pushing or pulling when accelerating or transporting said shipment set.

Said means for determining based on said information if the shipment set needs or allows a specific treatment at certain processing stations within said packaging system may comprise a computer or one or more dedicated processors and one or more nontransitory processor-readable media (such as for example volatile memory such as random access memory (RAM), non-volatile memory such as read only memory (ROM), storage media such as a magnetic hard disk drive, optical disk drive, solid state drive (SSD) or FLASH drive) communicatively coupled with the processor(s). In general, the invention also relates to a computer program comprising instructions, which, when the program is executed by a computer, causes the computer to carry out certain steps of a method for controlling the processing of varying shipment sets of one or more item(s) in an automated packaging system for packaging said varying shipment sets in custom-sized boxes made from cardboard blanks.

Said means for configuring said at least one of said processing stations with instructions for the specific treatment of said shipment set may comprise wire-based or wireless communication equipment for communication between the control system and the packaging system or its components like processing stations and transport equipment like conveyors for transporting shipment set to and through the stations of the packaging system. The control system may send control signals to the packaging system respectively directly to its components, and the packaging system or its components may send feedback to the control system, for example to confirm receipt of a control signal or to inform the control system about failures/interruption that may have occurred upon processing a shipment set for example to facilitate constant optimization of the system in a self-learning manner. Accordingly, the method of the invention may be implemented such that feedback from said packaging system about specific treatments performed at certain processing stations is used in a self-learning manner to adapt instructions for the specific treatment of shipment sets that will in the future be processed by the packaging system.

In one embodiment, a method for automatically packaging varying shipment sets in custom-sized cardboard boxes comprises:

- preparing a shipment set of one or more items to be shipped,
- obtaining information on the overall length, width and height dimensions of the shipment set to be packaged and optionally on its weight,
- calculating, based on said dimensions the layout of a cardboard blank for a box with an attached lid or the layouts of cardboard blanks for a box and a corresponding separate lid, said box having a bottom panel,
- cutting and creasing cardboard to form a blank for a box with an attached lid or to form a cardboard blank for a box and a blank for a separate lid having the calculated layout(s),
- placing the shipment set on said bottom panel prior or after folding a box out of said cardboard blank,
- closing the box with said lid, and
- performing a method for controlling the processing of the shipment set as outlined above.

In one embodiment, a packaging system for automatically packaging varying shipment sets in custom-sized cardboard boxes, comprising

- an entry station comprising structure for obtaining information on the overall length, width and height dimensions of a shipment set consisting of one or more item(s) to be packaged and optionally on its weight,
- a calculation unit for calculating, based on said dimensions the layout of a cardboard blank for a box with an attached lid or the layouts of cardboard blanks for a box and a corresponding separate lid, said box having a bottom panel,
- a cutting and creasing station comprising structure for cutting and creasing cardboard to form a blank for a box with an attached lid or to form a cardboard blank for a box and a blank for a separate lid having the calculated layout(s),
- a box forming station for folding a box out of said cardboard blank comprising structure for placing the shipment set on the bottom panel prior or after folding the box,
- a closing station for closing the box with the lid,
- structure for transporting the shipment set to be packaged to and through the respective stations of the packaging system, and
- a system for controlling the processing of the shipment set as outlined above.

Further details and advantages of the invention will become apparent from the following detailed description of embodiments in conjunction with the drawing, which comprises nine drawing figures.

DESCRIPTION OF PREFERRED EMBODIMENTS

Figure 1:
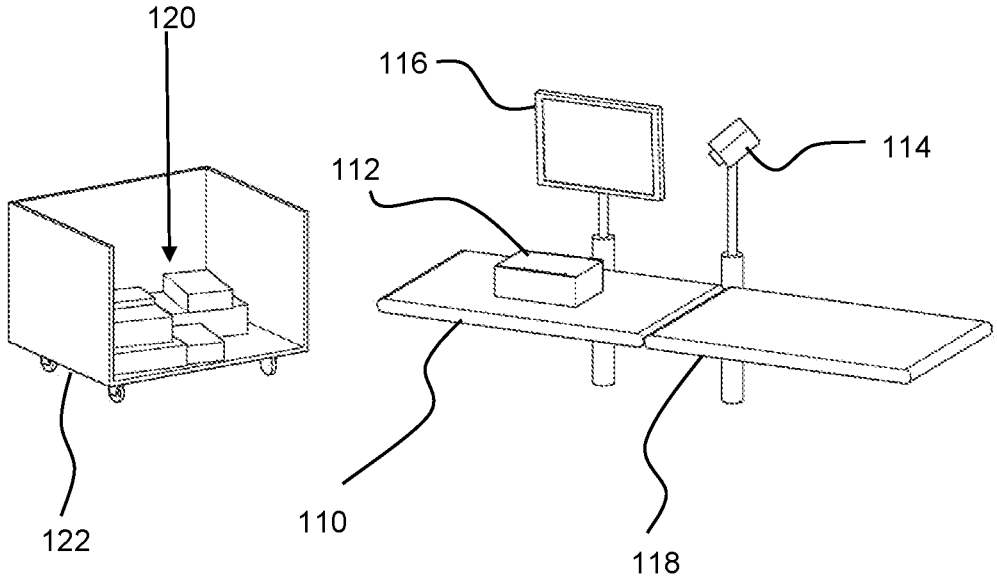
FIG. 1 illustrates items and hardware at an entry station of a packaging system for automatically packaging varying shipment sets in custom-sized cardboard boxes.

FIG. 1 schematically shows a very simple arranging station of a packaging system for automated packaging shipment sets. The station comprises a conveyor 110 on which the items forming shipment sets are arranged for later being automatically packaged. In the shown situation, just one item 112 is placed on the conveyor 110. The station is equipped with a camera 114 for obtaining an image of the item and with a display 116, and is arranged upstream of an entry conveyor 118, which transports a shipment set into a packaging system. Multiple sensors and readers may be provided at the arranging station, like a bar code reader or an RFID tag reader for reading bar codes resp. RFID tags provided on the items, and a scale, in particular a scale integrated in the conveyor for weighing the items. In the shown example, the items forming the shipment sets are taken manually by an operator from a set of items 120 provided via a cart 122.

Figure 2:
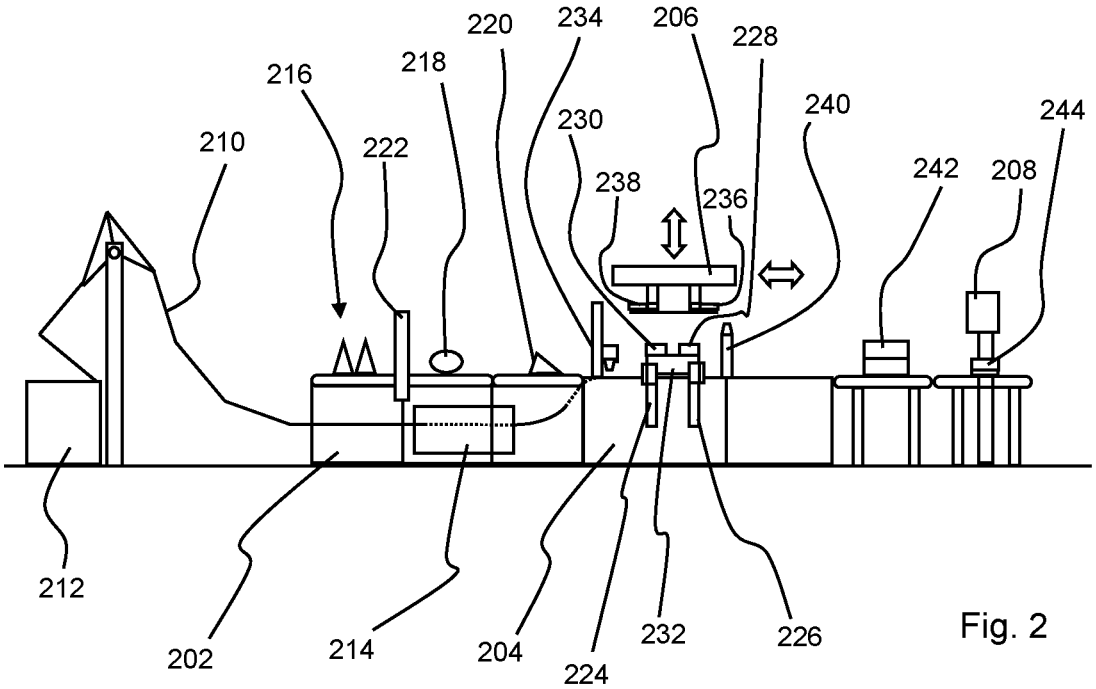
FIG. 2 is a schematic view of a prior art packaging system which or the operation of which is to be improved according to the invention.

One or more stations as illustrated in FIG. 1 may be foreseen in a complex packaging system and provide shipments sets arranged by an operator via the entry conveyor 118 to a receiving unit 202 shown in FIG. 2, which basically shows a conventional packaging system of WO 2019/081773 A1, the disclosure of which document is herewith incorporated entirely by reference.

The packaging system shown in FIG. 2 provides a sequence of processing stages with receiving unit 202, the combination of a folding station 204 and a lid placing station 206 and a final processing section and the labelling unit 208.

Cardboard 210 is supplied from a stack 212 of zig-zag folded cardboard to a station 214 for cutting the cardboard, punching out slots between corner panels and side panels and introducing crease lines to delimit respective panels from each other and to thus produce a blank for a custom-sized box. The respective dimensions of the panels are calculated using a calculating unit, which can form part of a control system for controlling the complete packaging system and which may for example be integrated in the receiving unit 202, where shipment sets like the items constituting the shipment sets 216, 218 and 220, which shall be packaged, are placed. In general, it should be understood that in some embodiments of the invention the entire packaging process can be controlled by using one dedicated computing unit, such as in particular a programmable logic controller. Nevertheless, seen from a functional/logical viewpoint, the packaging process and the packaging system can be divided in stations. In this sense, a station can be for example a conveyor, and one might say that the automated packaging system with its integrated control unit(s) configures the processing stations. In some embodiments, one might say the automated packaging system obtains the information on the shipment set and based on that configures the processing stations to perform their work in a specific way. Thus, the control unit method may be integral part of a respective packaging system or may be a separate system influencing the packaging system.

The items to be packaged are transported via conveyor belts through a laser scanning unit 222, which measures the outer dimensions of the items passing through the unit in order to obtain information on the desired inner dimensions length, width and height a box needs to have in order to receive the items or the arrangement of items as they are, i.e. without re-arranging the items. The cardboard blank is transported from the cutting and creasing station 214 to the folding station 204, where the item or the items to be packaged are put on top of a bottom panel of the respective blank cut and creased in the cutting and creasing station. Respective grippers and folders like the gripping and folding units 224 and 226 fold the box around the item(s) to be packaged. In this case, the box layout comprises so called side panels, end panels and corner panels. Two corner panels 228 and 230 are folded upwards, then the end panels are folded inwards thus folding also the corner panels inwards and finally the side panels, of which side panel 232 is visible in this view, upwards.

When the respective blank is transported from the station 214 to the station 204, it passes a glue application unit 234, which applies hot melt glue to the parts of the side panels, which are to be brought into contact with the corner panels.

To close the box, in this embodiment the lid placing station 206 is provided, which as indicated by the double-sided arrows is moveable upwards and downwards, forwards and rewards in the transport direction of the items respectively the boxes. Similar to the blanks for the box, based on the calculated dimensions a blank for the lid is produced and picked up by the lid placing station 206 for example with suction grippers that can be integrated in respective folding units 236 and 238 of the lid placing station. A gluing unit 240 applies hot-melt glue to the end panels and the side panels of the lid, which is placed on top of the box that just has been erected, upon which the end panels and the side panels of the lid are folded downwards. The thus closed boxes 242, 244 are then transported via respective conveyor belts to the label printing and application unit 208, which puts a label including for example address of the recipient and postage on the boxes, which then can be picked up and further transported.

The lid can be created from the same cardboard supplied as the box, in case of which the cutting and creasing station may be set up to produce not only a blank for the box, but also a blank for the lid, which may then be transported via respective conveyor belts to the lid placing station, which picks up the lid and puts it on top of the box. It should be understood that the packaging system shown in FIG. 2 is presented for facilitating understanding the packaging process and is of rather simple nature. Modern high speed packaging systems that allow packaging 1000 and more shipment sets per hour perform typically between ten and twenty stages of a packaging process, and accordingly a high number of transportation means like conveyor belts or transportation fingers, of which the respective acceleration/deceleration can be controlled according to the invention.

Figure 3:
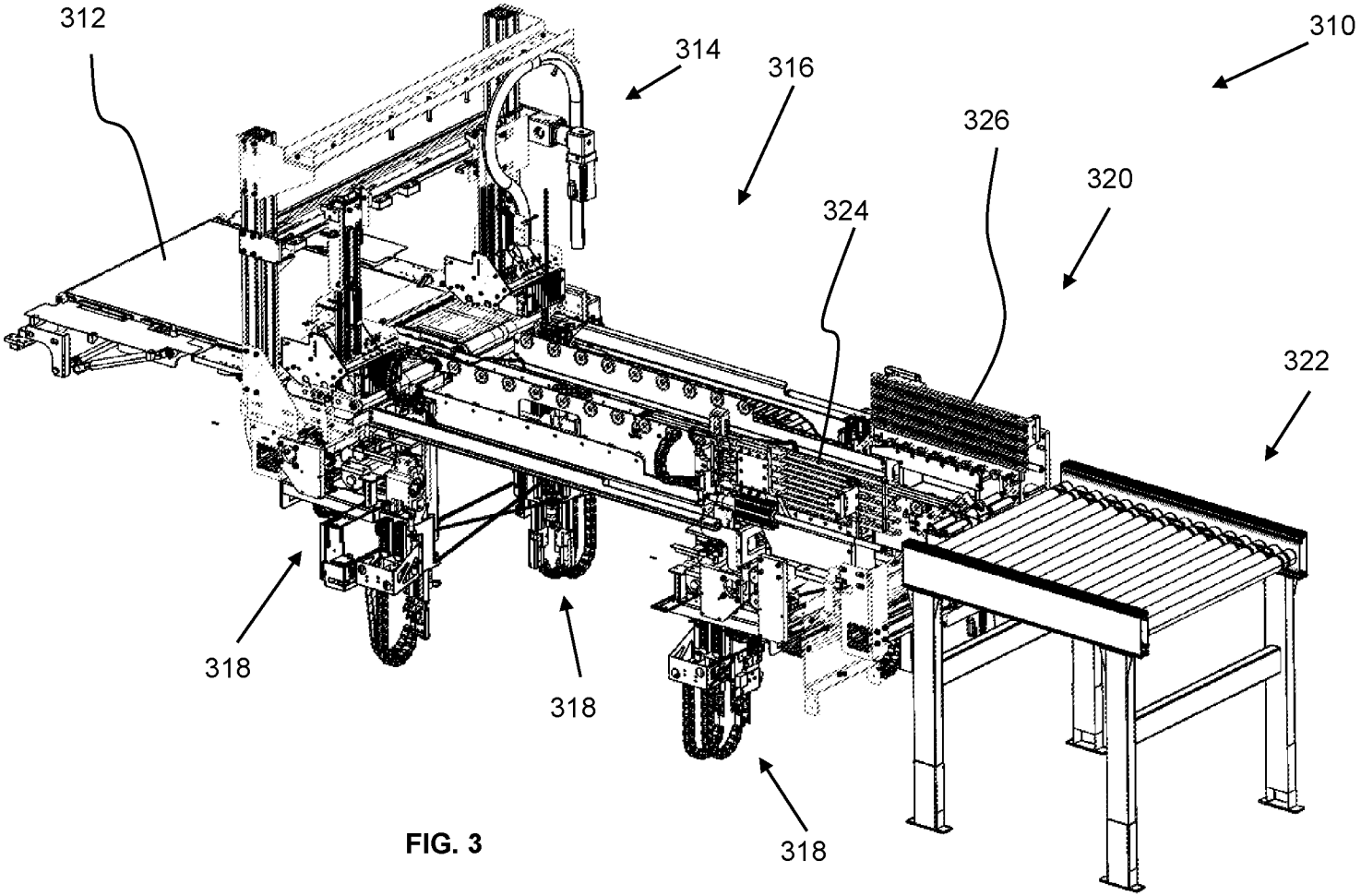
FIG. 3 is a schematic perspective view of parts of a packaging system for automatically packaging varying shipment sets in custom-sized cardboard boxes.

FIG. 3 shows parts of a packaging system 310 for automatically packaging varying shipment sets in custom-sized cardboard boxes, namely an input or assembly station 312, where during operation shipment sets are placed on a custom-sized cardboard blank having a layout like the one shown under item 0300 in the aforementioned International Fibreboard Case Code, a glue application station 314, where glue is applied to parts of the side panels of the blank that will come in to contact with the respective corner panels, a folding station 316 comprising four folding units 318 adjustable in their position to handle differently sized blanks, a curing station 320 and a pick-up station 322, where the final folded boxes arrive when the glue has cured and are picked-up for further processing.

The curing station 320 comprises holding structure for form-fittingly holding the side panels of a box erected in the folding station 316 and for guiding the boxes through the curing station. The holding structure comprises in particular two side guiding elements 324, 326 that are substantially parallel to each other while the distance between them is adjustable to different box widths.

Figure 4:
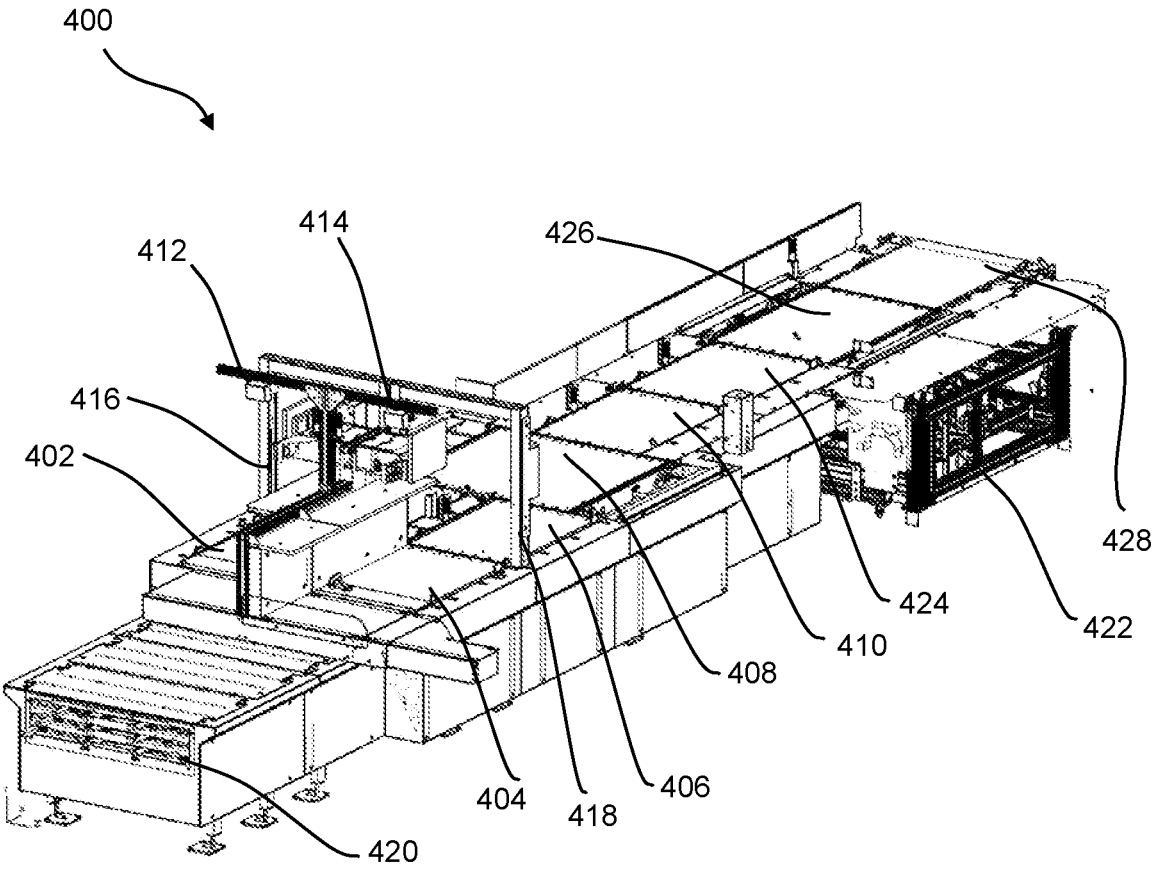
FIG. 4 is a schematic perspective view of further parts of a packaging system for automatically packaging varying shipment sets in custom-sized cardboard boxes.

FIG. 4 shows schematically the general layout of the entry part 400 of a more complex packaging system comprising in this case two entry stations, where items of shipment sets are arranged manually or automatically for example by using robotic placement stations and or automatic feed mechanism. Each entry station comprises a first conveyor 402 resp. 404 associated with respective second conveyors 406 (of which only one is visible), which are preferably conveyor belts and are configured to transport the respective shipment set arranged directly on them or loaded onto them towards a third conveyor 408, which comprises preferably also a conveyor belt and which is configured to transport the items towards a fourth conveyor 410 while being itself moveable in a direction between the second conveyors 406. The third conveyor 408 thus allows merging the flows of arrangements of one or more items from the entry stations and is thus also called a merge conveyor.

The entry part 400 also includes a first barcode scanner 412, a second barcode scanner 414, a first 3D scanner 416 for identifying the dimensions of an arrangement, a second 3D scanner 418 for identifying the dimensions of an arrangement, a cardboard entry 420 for feeding cardboard into the packaging system 400 and a cut and crease unit 422 for creating box templates.

In this embodiment, the second conveyors 406 serve as "queueing conveyors" where shipment sets can wait for being transported onto the merge conveyor 408. Downstream of the queueing conveyors is the merge conveyor 408 that can receive shipment sets from both queueing conveyors. After the merge conveyor 408 there are in this embodiment two conveyors 410, 424 followed by the align conveyor 426, which is followed by another conveyor 428. Below the conveyors are cardboard tracks. Below the align conveyor 426 and the conveyor 428 is the cut and crease unit 422 for creating a custom-sized cardboard blank in a manner known in the art.

Figure 5:
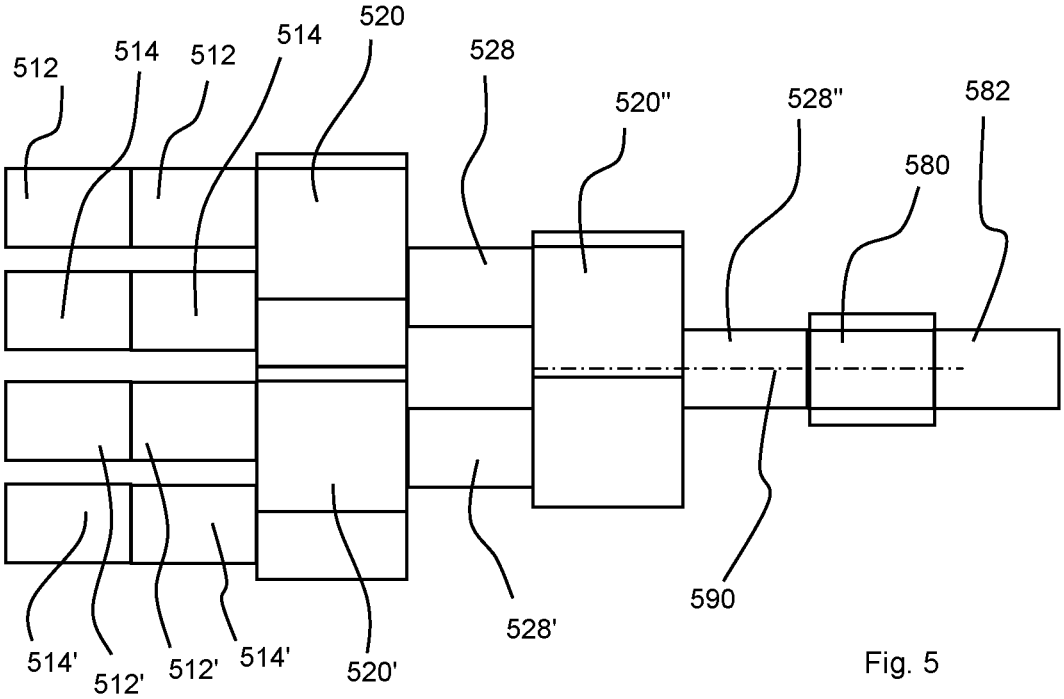
FIG. 5 shows schematically parts of a packaging system for automatically packaging, namely an arrangement of two so-called merge conveyors and one so-called align conveyer in a cascaded configuration.

FIG. 5 shows a configuration of the entry part of a complex packaging system in which three merge conveyors 520, 520' and 520" are cascaded. The first merge conveyor 520 is fed by a number of first and second conveyors 512 and 514 and feeds a first so called "fourth conveyor" 528. The second merge conveyor 520' is fed by a number of first and second conveyors 512' and 514' and feeds a second fourth conveyor 528'. The two fourth conveyors 528 and 528' are arranged parallel to each other and feed the third merge conveyor 520", which in turn feeds yet another fourth conveyor 528" feeding a fifth conveyor 580, which is configured for transporting the shipment sets towards a packaging station while at the same shifting them as necessary with respect to the dashed-dotted line 590, which indicates the center line of a box to be created and on which—seen in the traveling direction towards the box to be created—the center of the respective shipment set should be placed. Conveyor 580 hence also functions as a so-called align conveyor in cases, in which the respective shipment set has not already been fully aligned by the conveyor 520" with respect to the box to be created. Conveyor 580 feeds a sixth conveyor 582, which may already lead shipment sets onto a bottom panel of a box for packaging the items or which may hand over the shipment set to a respective packaging station.

Figure 6:
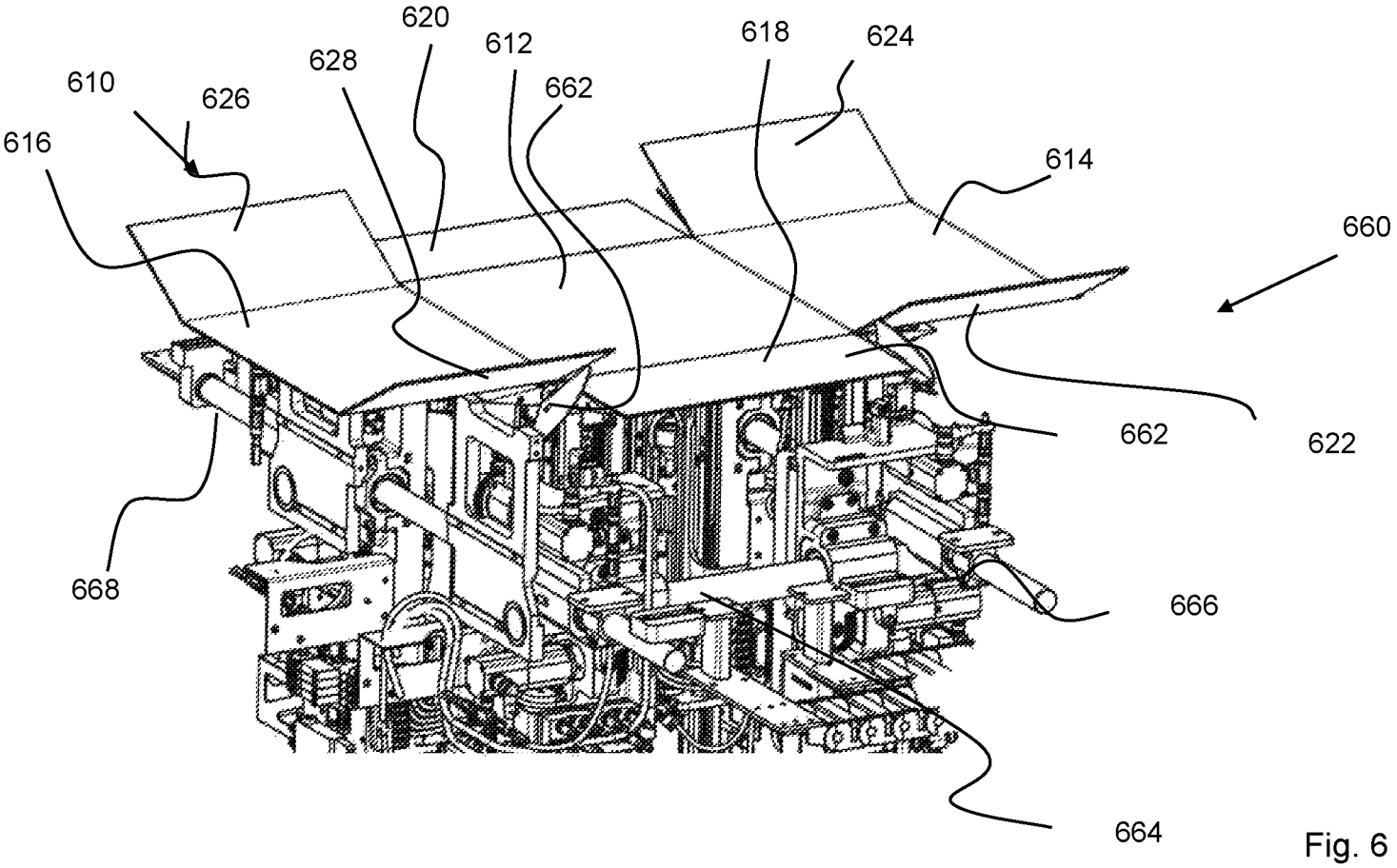
FIG. 6 shows some parts of a folding station for folding cardboard blanks.

FIG. 6 shows schematically some parts of a folding station 660 for folding cardboard blanks like the blank 610 to form packaging boxes. The blank 610 has a layout, in which the height of the so-called end panels 614 and 616 is greater than the height of the so-called side panels 618 and 620.

The folding station 660 shown comprises four folding units, each comprising a corner panel folding element 662, of which in the shown situation, in which a cardboard blank 610 has been placed on the folding station and the corner panel folding elements 662 have started to push the so-called corner panels 622, 624, 626 and 628 of the blank 610 upwards, only two are visible.

The folding units are slidably mounted on rods 664, 666 and 668 in order to be moveable in a plane parallel to the plane of the cardboard blank 610, as the cardboard blanks to be folded may in this embodiment differ in size and hence the positions of the panels of the cardboard blank to be folded by the folding station 660 may vary from blank to blank. The shown folding station 660 is of exemplary nature to facilitate understanding the folding process.

The folding station 660 forms part of an automatic packaging system, in which custom sized boxes and corresponding lids can be created from cardboard fed into the packaging system usually from stacks of zig-zag folded cardboard and in which items to be shipped are automatically packaged in the boxes formed. Such system is disclosed for example in WO 2014/117817 A1. Such automatic packaging system comprises a blank forming apparatus, in which the cardboard is cut and creased to form a custom sized blank, which then can be folded automatically. The packaging system also comprises one or more glue application units (not shown in these schematic drawings) for applying glue on at least one of the panels of the blank 610 that are to be glued together. Such glue application unit may be adapted to apply portions of hot melt glue with at least two different surface-to-volume ratios, which can contribute to speeding up the whole process as the portions having a higher surface to volume ratio may cure faster and thus fix the panels provisionally, while the other portion may contain more glue and may lead, once cured, to a stronger bond.

The glue application unit may also be adapted to apply portions of hot melt glue on the sidewalls of the erected box and/or on the flaps of a lid for adhering the flaps to the sidewalls. Depending on the general layout of the packaging system, it may be more efficient to provide one or several separate glue application units for separate gluing steps.

It should be noted that the glue can in principle be any adhesive, while it will typically be hot melt glue, which is easy to handle in automated packaging systems and cures fast. For sake of simplicity, in the following it will be assumed that the glue is hot melt glue and the process in which it hardens and binds those parts, between it is placed, together will be denoted as curing, although the invention is equally useful if other types of glue are used, that may not harden but that will stay soft even when the glue has set. Thus, the invention is not limited to packaging systems using hot melt glue or packaging systems using glue at all, as the flaps of a lid can be attached to the respective sidewalls for example by an adhesive tape.

A lid for closing a box may be folded using a folding station comprising similar elements as the ones described above for the box folding station. Depending on the general layout of the packaging system, some folding elements used for folding the box may also be used for folding the flaps of a lid, while typically the closing of the box will happen in a separate station so that separate folding elements will be provided for folding the lid. However, the general mechanics of the folding elements is identical or highly similar, as will be understood by an expert in the art from the disclosure provided herein.

Figure 7:
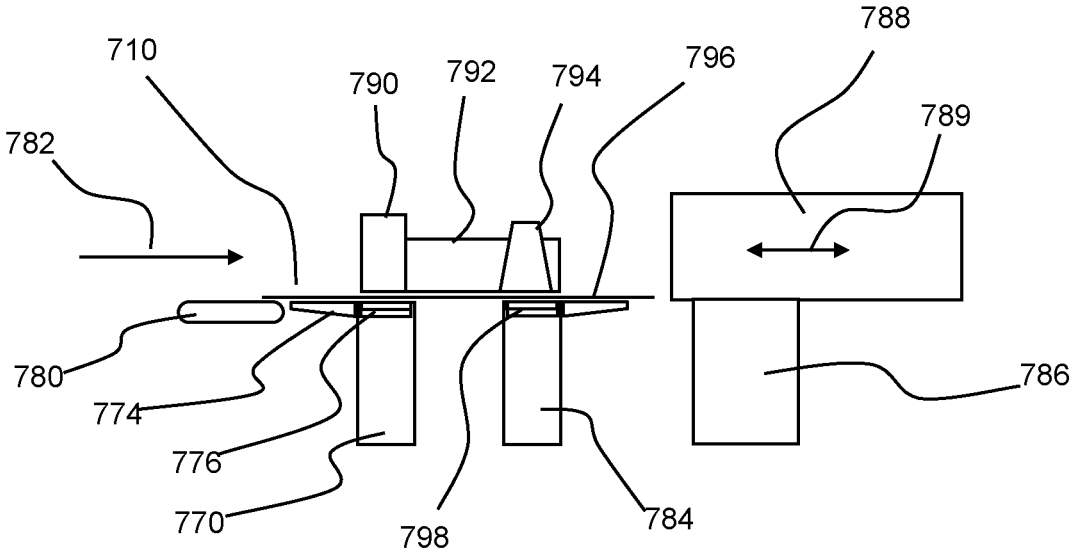
FIG. 7 shows schematically parts of a packaging system for automatically packaging varying shipment sets in custom-sized cardboard boxes, namely parts of a folding station and curing station for folding cardboard blanks into boxes and gluing respective the panels of the blanks.

FIG. 7 shows schematically a part of a packaging system for automatically packaging shipment sets, which comprises a feeding conveyor 780 for feeding a cardboard blank 710 in a processing direction 782 into a folding station that in this case comprises four folding units folding arranged in pairs forming a pair of rear folding units, of which one folding unit 770 is visible, and a pair of front folding units, of which one folding unit 784 is visible. In the shown example, the pairs of folding units are movable relative to each other.

The packaging system also comprises one or more glue application units (not shown in the schematic drawing) for applying glue on at least one of the panels of the blank 710 that are to be glued together and a curing station formed by a base 786 and holding structure to take over the boxes or lids or combinations of a box and a lid formed at the folding station and to guide them through the curing station while form-fittingly holding the panels that are glued together allowing the glue to cure. The glue application unit may be adapted to apply portions of hot melt glue with at least two different surface-to-volume ratios, which can contribute to speeding up the whole process as the portions having a higher surface to volume ratio may cure faster and thus fix the panels provisionally, while the other portion may contain more glue and may lead, once cured, to a stronger bond.

Of the holding structure, which supports, seen in the processing direction, the sides and the bottom of—in this case an open—box, a first side guiding element 788 is visible, while a second side guiding element substantially parallel to the first side guiding element 788 is provided. The distance of the side guiding elements and the distance of the folding units in the width direction, which is the direction orthogonal to the processing direction 782 in the plane of the blank 710, are adjustable to different widths of boxes or lids or combinations of a box and a lid to be folded in the folding station. The side guiding elements 788 may for example be formed by panels or arrangements of rods and may be extendable in their length seen in the processing direction 782. A detailed example of a holding station is given in FIG. 8.

The packaging system further comprises a transport device (not shown) for transporting the box fully into and through the curing station.

In the situation shown in FIG. 7, some items 790, 792, 794 forming a shipment set have been placed on blank 710, either before or after handing over the blank from the feeding conveyor 780 to the folding station.

Each folding unit 770, 784 comprises a cornel panel folding element (not shown in the schematic drawing), a blank fixing element (also not shown), an end panel folding element 774, 796 and a side panel folding element 776, 798. In a first step of the folding process according to this example, the front and rear corner panels 722, 728 and the front and rear end panels are erected.

Once all panels are erected, the box is handed over to the curing station, such that the side guiding elements contact a portion of the respective side panels and hold them in place allowing the hot melt glue to cure. To facilitate handing over, the side guiding elements 788 are movable towards and away from the folding station as indicated by arrow 789. In this embodiment, also the rear folding units 770 are movable towards the front folding units 784 and thus towards the curing station. Transporting the box fully into and through curing station may be done by a suitable transport device such as one or more movable fingers pushing the box or revolving rubber and/or vacuum belts integrated in the holding structure and pulling the box through the curing station.

Figure 8A:
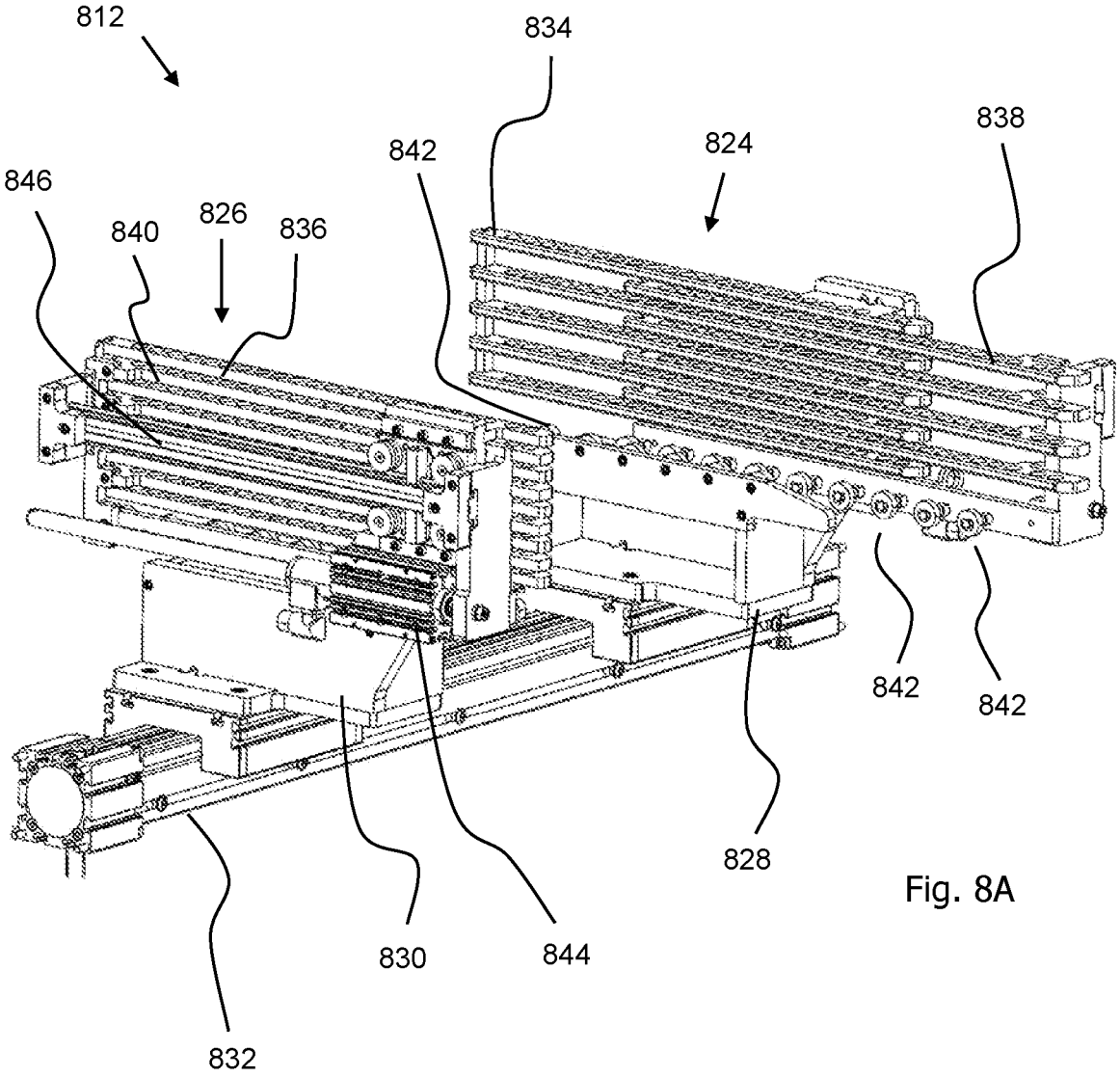
FIGS. 8*a* and 8*b* show parts of a curing station of a packaging system for automatically packaging varying shipment sets in custom-sized cardboard boxes.
Figure 8B:
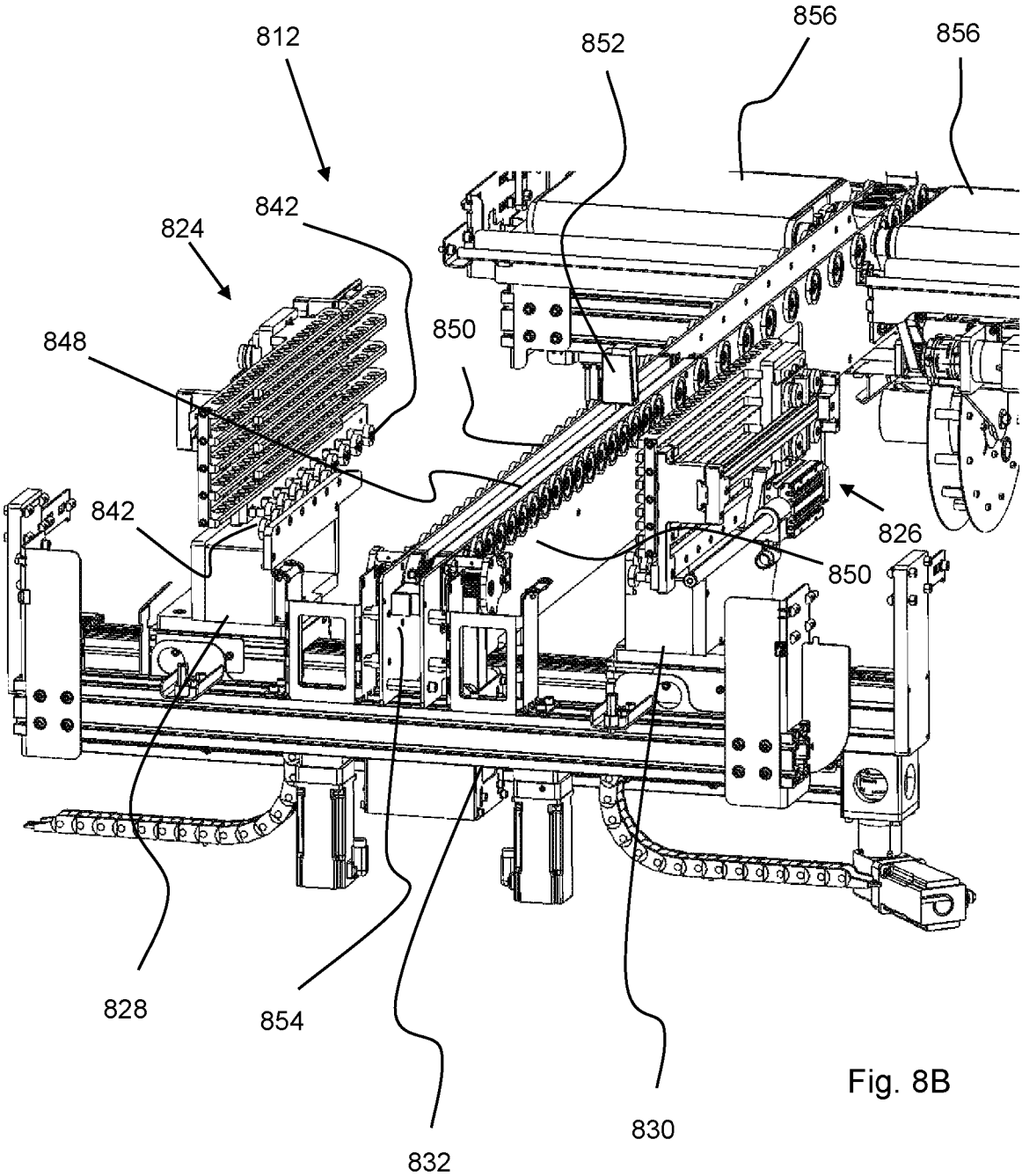

FIGS. 8*a* and 8*b* show parts of a curing station 812 from different perspectives. The curing station 812 comprises two side guiding elements 824, 826 movably mounted via blocks 828, 830 on a rail 832 such that the distance between them is adjustable to different box widths. In use, the side guiding elements 824, 826 synchronously move in opposite directions along the rail, i.e. towards to or away from each other, such that there is a fixed center line.

The side guiding elements are extendable in their length seen in the processing direction. To this purpose, each side guiding element 824, 826 has a fixed part 834, 836 and a movable part 838, 840, each part being formed by an assembly of parallel guide bars. Both, the fixed and the movable parts comprise a number of support rollers 842, of which for sake of clarity only some have been provided with reference numbers. The support rollers 842 carry the boxes when they are being transported through the curing station 812. As they are present on both, the fixed and the movable parts, support for the bottom of a box is provided throughout the curing station 812.

In order to facilitate understanding the functioning of the extendable side guiding elements, element 824 is shown in FIG. 8*a* a position, in which the movable part 838 has been moved to a partially extended position, in which it extends the length of the side guiding element 824, while movable part 840 is in a non-extended position. During operation of the curing station, the movable parts 838, 840 would be moved (if extending the side guiding elements 824, 826 is desired) synchronously by a respective linear motor 844 along a respective guide rail 846. The advantage of extendable side guiding elements is that they can provide support over a longer distance so that longer boxes can be supported. In other words, long boxes can be supported over their full length with a curing station having side guiding elements that are in the non-extended position shorter than the respective boxes.

As shown in FIG. 8*b*, a central track 848 with rows of support rollers 850 on both sides is provided. For sake of clarity, only two support rollers 850 are provided with reference numbers.

The central track 848 accommodates a transport chain having one or more transport fingers 852, 854 which are adapted to push boxes handed over from a folding station, of which only parts like for example conveyors 856 are shown, through the curing station 812. The transport chain may have two revolving fingers and may be configured so that when one of the fingers moves with a box through the curing station, the other finger moves back at the bottom side of the chain. Advantageously, two independently controllable transport chains with one or more fingers may be provided, one chain adapted to push a box through the curing station by pressing with a finger against the rear end panel of the box, while the other may be adapted to provide support for the front end panel of the box during its transport through the curing station.

When two independently controllable transport chains each with one or more fingers are provided, the packaging system may be configured such that the finger that pushes a box through the curing station will support the front side of the next box. In such configuration, the finger may stop at the end of the curing station, when it has pushed the current box out of the curing station, and may then return to a position near the entry of the curing station, where it can contact and support the front end panel of the next box. It may then move with that box through the curing station, turn at the end of track 848 by about 90° around an end of the track to allow the box to be pushed out of the curing station. Finger 854 is shown in such position. Depending on the configuration of the transport chains and the track, the finger may then be moved above or underneath track 848 to the entry of the curing station 812 for pushing the next box through the station.

Figure 9A:
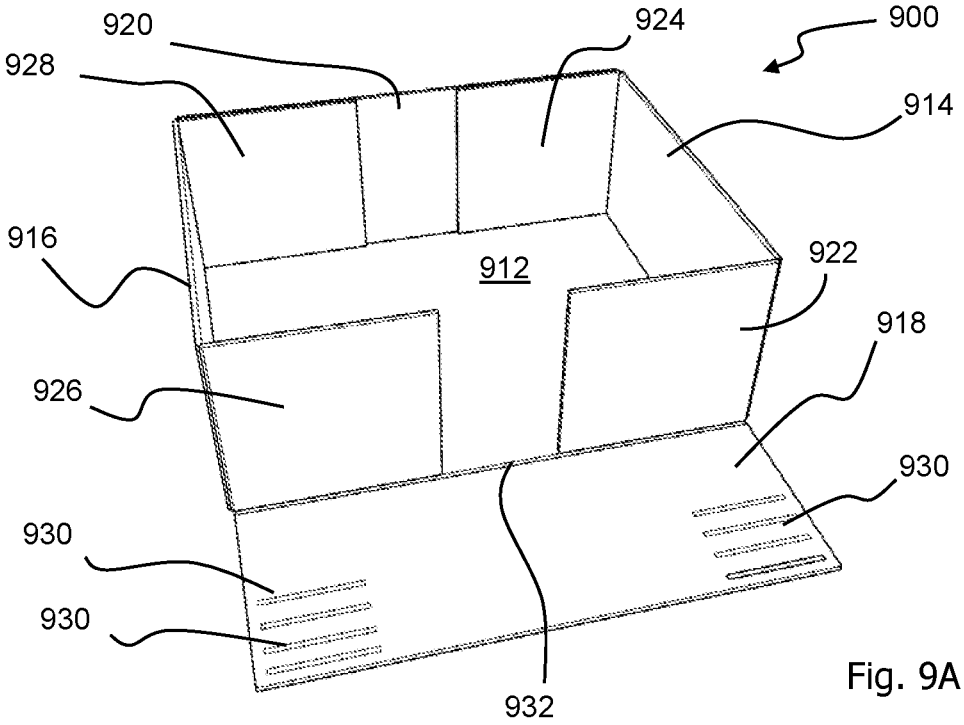
FIGS. 9*a*, 9*b* and 9*c* show tray boxes having the same general layout but differently sized panels to illustrate some problems addressed by the invention.
Figure 9B:
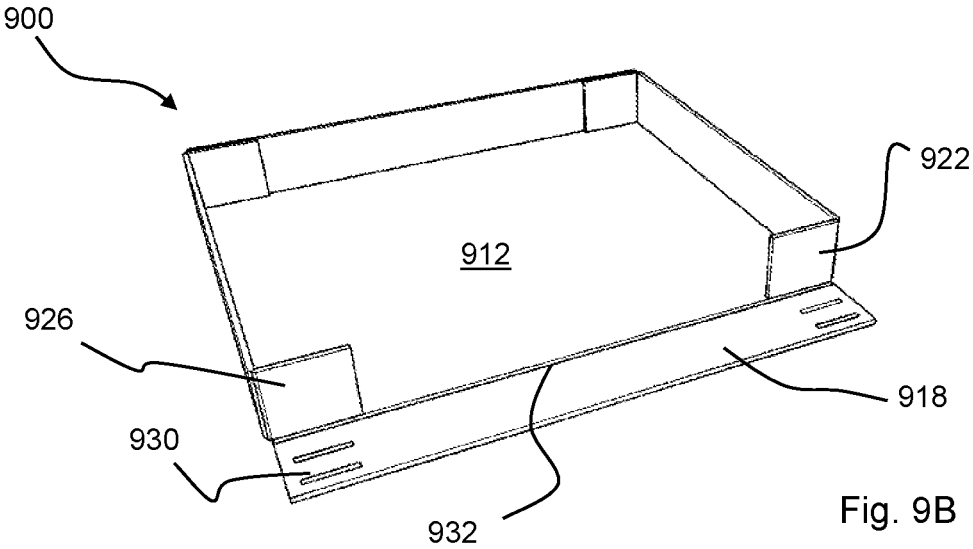
Figure 9C:
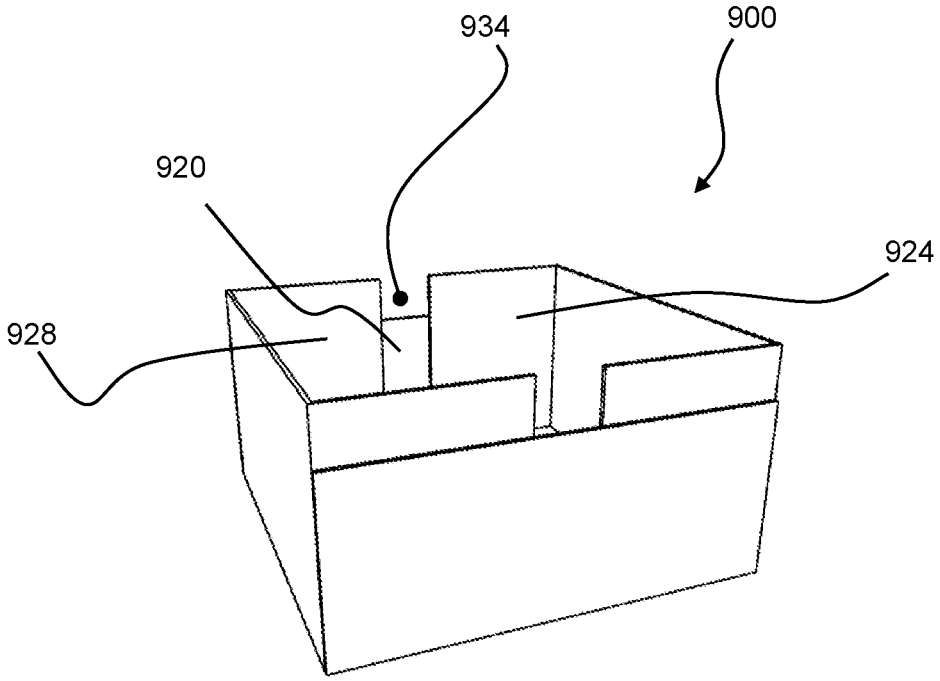

FIGS. 9*a* through 9*c* show different examples of custom-sized tray boxes 900, each having the same general layout but differently sized panels, namely a bottom panel 912, a first end panel 914, a second end panel 916, a first side panel 918, a second side panel 920, two first corner panels 922 and 924 joined to opposite edges of the first end panel 914 and two second corner panels 926 and 928 joined to opposite edges of the second end panel 916. For sake of simplicity, not all panels in all figures have been provided with reference numbers.

To facilitate understanding some of the problems addressed by the present invention, the box is shown in FIGS. 9*a* and 9*b* with an open, i.e. not yet attached to the corner panels 922 and 926 side panel 918, while the opposite side panel 920 has already been attached to the respective corner panels. The panels are typically fixed to each other by applying lines 930 of hot melt glue, of which only some have been provided with reference numbers.

As shown in the FIGS. 9*a* and 9*b*, the contact area between the corner panels and the side panels depends on the height of the box. As the automatic glue applicators used in packaging systems for automated packaging typically require a certain minimum distance between adjacent glue lines, not only is the length of the glue lines 930 applicable to the contact area between the side panel 918 and the corner panels 922 and 926 shorter than that of the glue lines 930 applicable for the box shown in FIG. 9*a*, also the number of glue lines 930 is reduced.

Besides, as the glue lines are closer to the crease line 932 delimiting the side panel 918 from the bottom panel, the leverage resulting from the adhesive forces between the corner and the side panels with respect to the crease line 932, which can be regarded as a pivot axis of the side panel 918, is less, making it more difficult to hold the side panel in an upright position. The problem is increased as the ratio length of the side panel seen in the direction of said crease line versus its height increases. Thus, if pressure applied to the outside of the side panel to push the side panel against the corner panels is released before the glue has fully cured, the side panel may open due to the return forces from the card board and/or due to any items inside the box that may upon accelerating fall against the side wall formed by the corner panels and the side panel. Hence, the processing speed, for example the time spent by a box in a respective curing station, needs to be adjusted to ensure ample time for sufficient curing of the glue. In contrast, if said e.g. the leverage is high, said return forces are low, more glue can be applied and/or if the danger that items inside the box fall against a side wall does not exist, the glue does not need to be fully cured and the process speed can be kept at a high level or can even be increased.

FIG. 9*c* illustrates another problem that may occur. Depending of the specific dimensions of the panels, a gap 934 may exist between the corner panels and the respective side panel forming a sidewall (in FIG. 9*c* only the gap between the corner panels 924 and 928 and the side panel 920 is provided with a reference number). This gap may be greater depending on the specific layout of the blank, and if a shipment set is comprised of multiple items stacked on top of each other, there may be a risk that an item falls out of the box if the box is accelerated/decelerated to much before a lid is placed on top of the box that closes the gap. In such cases, the invention allows limiting the acceleration and/or deceleration of the box until it is fully closed.

All stations including conveyors and transportation elements like the transport fingers can be controlled by a control method respectively a control system according to the invention, that may, depending on the general layout of the control employed by the packaging system, control the complete packaging system or may just interact with the packaging system or its specific processing stations when needed, i.e. when a shipment set requires special treatment like low accelerations/decelerations. The set up may be that each processing station of the packaging system has its own control unit communicatively coupled directly or indirectly with a control system according to the invention. For example, a conveyor for transporting a box with a shipment set from a folding station to a lid placing station may be configured with its own control unit that starts the movement of the conveyor with a certain acceleration each time the presence of a box to be transported is detected for example by a light barrier. If the box contains a shipment set that needs a special treatment, the control unit may get from a control system according to the invention a control signal that leads to the restriction of the acceleration to a certain extend. As outlined above, special treatment may also be the information that a shipment set can be treated faster than normal.

In one embodiment, feedback from said packaging system about specific treatments performed at certain processing stations is advantageously used in a self-learning manner to adapt instructions for the specific treatment of shipment sets that will in the future be processed by the packaging system, which allows automatic optimization of the method. For example, one approach could be to build up and constantly evaluate a database with information about which limits for e.g. the acceleration work best in case a shipment set has a certain weight. For example, it may be preset to limit an acceleration of x $m/s^2$ to y $m/s^2$ in case the weight of a shipment set exceeds a certain threshold value, but over time it may be automatically learned that the value of y $m/s^2$ still leads to processing errors/failures, and the value may be automatically decreased e.g. in a stepped manner by e.g. 10% or so.

In a preferred embodiment, the information about different physical properties is combined for determining if a shipment set needs or allows a specific treatment. For example, a shipment set may have a rather large weight normally leading to a reduction of the allowed acceleration/deceleration, but may be comprised of just one cuboid box ensuring a rather stable stand and a large contact surface with the bottom of a box, so that reducing the acceleration/deceleration may not be necessary.

The invention claimed is:

1. A method for controlling the processing of varying shipment sets of one or more item(s) in an automated packaging system for packaging said varying shipment sets in custom-sized boxes made from cardboard blanks, said packaging system comprising a plurality of processing stations performing different operations on said shipment sets, said operations including transporting said shipments sets to and through said processing stations, said method comprising:

acquiring information about one or more physical properties of a shipment set or of one or more items forming the shipment set, determining based on said information if the shipment set needs or allows a specific treatment in or on the transport to and through one or more of said processing stations within said packaging system, and configuring said one or more of said processing stations with instructions for said specific treatment of said shipment set, wherein said specific treatment comprises at least one of:

decreasing or increasing a time spent in a curing station for curing a hot melt glue used to form a custom-sized box for said shipment set, or decreasing or increasing a time to hold a custom sized box containing said shipment set in a defined position to allow the contained shipment set to stabilize.

2. The method according claim 1, wherein one of said one or more physical properties is a weight of the shipment set or of the one or more items forming the shipment set.

3. The method according claim 2, wherein the information about the weight of the shipment set or of the one or more items forming the shipment set is acquired by at least one of using a scale, obtaining data from a database, or monitoring a current of a conveyor or a transport element pushing or pulling when accelerating or transporting said shipment set with or without a box.

4. The method according to claim 1, wherein one of said one or more physical properties is a shape of the shipment set or of the one or more items forming the shipment set.

5. The method according to claim 1, wherein one of said one or more physical properties is a dimension of the shipment set in each of a plurality of spatial directions.

6. The method according to claim 1, wherein one of said one or more physical properties is a dimension of each item in the shipment set in each of a plurality of spatial directions.

7. The method according to claim 1, wherein one of said one or more physical properties is a spatial position of a center of mass of each item in the shipment set.

8. The method according to claim 1, wherein one of said one or more physical properties is a spatial position of a center of mass of an aggregate of all of the items in the shipment set.

9. The method according to claim 8, wherein said specific treatment comprises at least one of:

decreasing or increasing an allowed acceleration when transporting said shipment set, decreasing or increasing an allowed deceleration when transporting said shipment set, decreasing or increasing an allowed transportation speed when transporting said shipment set.

10. A method for automatically packaging varying shipment sets in custom-sized cardboard boxes, comprising:

preparing a shipment set of one or more items to be shipped, obtaining information on the overall length, width and height dimensions of the shipment set to be packaged and optionally on its weight, calculating, based on said dimensions the layout of a cardboard blank for a box with an attached lid or the layouts of cardboard blanks for a box and a corresponding separate lid, said box having a bottom panel, cutting and creasing cardboard to form a blank for a box with an attached lid or to form a cardboard blank for a box and a blank for a separate lid having the calculated layout(s), placing the shipment set on said bottom panel prior or after folding a box out of said cardboard blank, closing the box with said lid, and performing the method according to claim 1.

11. The method according to claim 1, wherein said specific treatment comprises at least one of:

decreasing or increasing an allowed acceleration when transporting said shipment set, decreasing or increasing an allowed deceleration when transporting said shipment set, or decreasing or increasing an allowed transportation speed when transporting said shipment set.

12. The method according to claim 11, wherein said decreasing or increasing is done in a stepped or stepless manner.

13. The method according to claim 11, wherein a linear relation, an exponential relation or a look-up table is used to determine a value for said decrease or increase.

14. The method according to claim 11, wherein said acceleration and/or deceleration are only decreased or increased in one or more specific transport directions.

15. The method according to claim 11, wherein feedback from said packaging system about specific treatments performed at certain processing stations is used in a self-learning manner to adapt instructions for the specific treatment of shipment sets that will in the future be processed by the packaging system.

16. The method according to claim 10, further comprising:

performing the method according to claim 11.

17. The method according to claim 1, wherein feedback from said packaging system about specific treatments performed at certain processing stations is used in a self-learning manner to adapt instructions for the specific treatment of shipment sets that will in the future be processed by the packaging system.

18. The method according to claim 10, further comprising:

performing the method according to claim 9.

19. A system for controlling the processing of varying shipment sets of one or more item(s) in an automated packaging system for packaging said varying shipment sets in custom-sized boxes made from cardboard blanks, said packaging system comprising a plurality of processing stations performing different operations on said shipment sets, said operations including transporting said shipments sets to and through said processing stations, said control system comprising means for acquiring information about one or more physical properties of a shipment set or the item(s) forming the shipment set, means for determining based on said information if the shipment set needs or allows a specific treatment in or on the transport to and through one or more of said processing stations within said packaging system, and means for configuring said one or more of said processing stations with instructions for said specific treatment of said shipment set, wherein said specific treatment comprises at least one of:

decreasing or increasing a time spent in a curing station for curing a hot melt glue used to form a custom-sized box for said shipment set, or decreasing or increasing a time to hold a custom sized box containing said shipment set in a defined position to allow the contained shipment set to stabilize.

20. A packaging system for automatically packaging varying shipment sets in custom-sized cardboard boxes, comprising:

an entry station comprising structure for obtaining information on an overall length, width and height dimensions of a shipment set consisting of one or more items to be packaged and optionally on a weight of the shipment set, a processor that calculates, based on said dimensions, a layout of a cardboard blank for a box with an attached lid or the layouts of cardboard blanks for a box and a corresponding separate lid, said box having a bottom panel, a cutting and creasing station comprising structure to cut and crease cardboard to form a blank for a box with an attached lid or to form a cardboard blank for a box and a blank for a separate lid having the calculated layout or layouts, a box forming station to fold a box out of said cardboard blank and comprising structure to place the shipment set on the bottom panel prior or after folding the box, a closing station to close the box with the lid, a transporter to transport the shipment set to be packaged to and through the respective processing stations of the packaging system, further comprising a system according to claim 19.

* * * * *